US006846074B2

(12) United States Patent
Hirai

(10) Patent No.: US 6,846,074 B2
(45) Date of Patent: Jan. 25, 2005

(54) INK-JET IMAGE FORMING METHOD

(76) Inventor: Yoko Hirai, c/o Konica Corporation, 1 Sakura-machi, Hino-shi, Tokyo, 191-8511 (JP)

( * ) Notice: Subject to any disclaimer, the term of this patent is extended or adjusted under 35 U.S.C. 154(b) by 93 days.

(21) Appl. No.: 10/453,570

(22) Filed: Jun. 2, 2003

(65) Prior Publication Data

US 2003/0222962 A1 Dec. 4, 2003

(30) Foreign Application Priority Data

Jun. 4, 2002 (JP) ..... 2002-162755

(51) Int. Cl.[7] ..... B41J 2/01
(52) U.S. Cl. ..... 347/102; 347/101
(58) Field of Search ..... 347/102, 101, 347/100, 95, 105; 106/31.13, 31.27, 31.6

(56) References Cited

U.S. PATENT DOCUMENTS 6,145,979 A * 11/2000 Caiger et al. ..... 347/102

* cited by examiner

*Primary Examiner*—Stephen D. Meier
*Assistant Examiner*—Manish Shah
(74) *Attorney, Agent, or Firm*—Squire, Sanders & Dempsey L.L.P.

(57) ABSTRACT

The invention relates to an ink-jet image forming method including: jetting UV-hardenable ink onto a substrate; and irradiating UV light to the jetted UV-hardenable ink on the substrate with a UV light source to form an image, wherein an ozone concentration above an irradiated surface of the substrate during the irradiating step is not more than 5 ppm by volume.

19 Claims, 2 Drawing Sheets

INK-JET IMAGE FORMING METHOD

TECHNICAL FIELD

The present invention relates to an ink-jet image forming method, particularly relates to an ink-jet image forming method using UV-hardenable ink.

BACKGROUND

An UV hardening type ink-jet image forming method is noticed as a method capable of solving the problem on the usual ink-jet method since the UV hardening type ink-jet method has merits such as that any specific substrate is not needed, the image formed by the method is excellent in the light fastness and the method is excellent in the working safety because the ink contains no solvent. The UV hardening type ink-jet method has high suitability to printer with high writing speed such as a line printer since drying process is not needed and the hardening time is short.

The UV-hardenable ink-jet ink is different from the usual printing ink and a coating material since such the ink is required to have low viscosity before the hardening so that the ink can be ejected from an ink-jet head. Thus, any reactive resin or binder almost cannot be added. Consequently, high polymerization degree is necessary. Accordingly, the hardening property and the property of the hardened layer tend to be varied depending on exterior factors compared with the printing ink and the coating material and the stable image formation is difficultly performed.

A high out put UV irradiation lamp such as a high-pressure mercury lamp and a metal halide lamp is usually used for hardening the ink image. Such the lamp causes occurrence of ozone since the lamp irradiates short wavelength UV light of not more than 200 nm. Therefore, there is a case that it is necessary to install an exhauster so as to prevent the pollution of the working environment since ozone is a gas harmful for the working environment. Further, in the case of the ink-jet ink, it has been found by the inventors that ozone causes a bad influence such as that the hardening ability of the image surface is degraded and the durability of the image is lowered even when the concentration of ozone is relatively low so that the influence on the working environment is a little. Such influences of ozone are not recognized until now.

SUMMARY OF THE INVENTION

An aspect of the invention is to provide an ink-jet image forming method excellent in the hardening ability of the image surface and the durability of the image.

The above aspect can be achieved by the following structures.

One structure of the invention is an ink-jet image forming method comprising the steps of jetting UV-hardenable ink onto a substrate, and irradiating UV light to the jetted UV-hardenable ink on the substrate with a UV light source to form an image, wherein an ozone concentration on an irradiated surface of the substrate during the irradiating step is not more than 5 ppm by volume.

Another structure of the invention is an ink-jet image forming method comprising the steps of jetting UV-hardenable ink onto a substrate, and irradiating UV light to the jetted UV-hardenable ink on the substrate with a UV light source to form an image, wherein the light source does not generate ozone, substantially.

In the above-mentioned ink-jet image forming method, a viscosity of the UV-hardenable ink at the temperature when the ink is jetted is preferably 2 to 50 mP·s.

In the above-mentioned ink-jet image forming method, it is preferable that the UV-hardenable ink contains a cationic polymerization initiator and a cationic polymerizable compound.

DETAILED DESCRIPTION OF THE INVENTION

Figure 1:
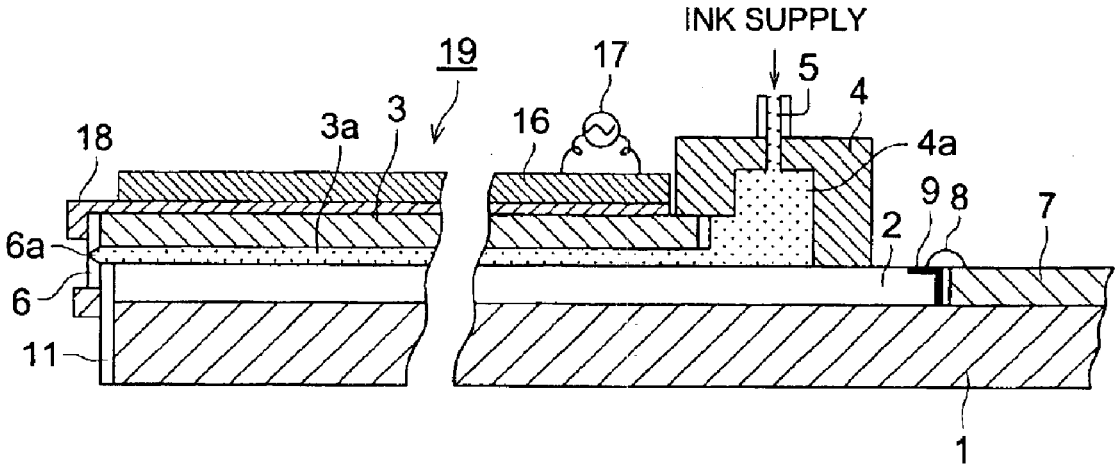
FIG. 1 shows a cross sectional view of an ink-jet head of an ink-jet printer, in which UV-hardenable ink usable in the invention can be used.

Hereafter, detailed explanations of the invention are described.

(Ink-Jet Head)

Conventional ink-jet heads can be used in the invention. A continuous type and a dot on demand type ink-jet head can be applied. Among the dot on demand type heads, a thermal head having a movable valve is preferable, which is described in Japanese Patent Publication Open to Public Inspection, hereinafter referred to as JP O.P.I. Publication, No. 9-323420. As a Piezo type head, those disclosed in EP-A-0277703 and EP-A-0278590 can be used. The head preferably has a temperature controlling function so as to control the temperature of the ink. It is preferred that the temperature of the ink is set and controlled so that the viscosity of the ink during jetting the ink is from 2 to 50 mP·s and the fluctuation of the ink temperature is within the range of ±5%. When the viscosity of the ink is lower than 2 mP·s, spreading of the ink can be increased and inconvenient can be caused for high speed ejection. When the viscosity exceeds 50 mP·s, the smoothness of the image can be lost and the suitability to the ejection can be degraded. The viscosity of the ink can be measured by a rotational viscometer such as DEL model manufactured by Tokimec Co., Ltd.

The driving frequency is preferably from 5 to 500 kHz.

The ink-jet head to be used in the invention has a nozzle pitch the same as or more than the resolving ability in the width direction. Plural heads may be combined so as the nozzle pitch is made the same as or more than the resolving ability when the nozzle pitch the same as or more than the resolving ability cannot be obtained. Similarly, plural heads can be arranged in the width direction when the printing width is large.

Light Source

The light source to be used in the invention is a light source generating light of a wavelength being within the UV region, preferable from 300 to 400 nm. Examples of the light source include a low-pressure mercury lamp, a high-pressure mercury lamp, a metal halide lamp, an excimer lamp, a xenon lamp, a halogen lamp, a fluorescent lamp, a cathode ray lamp, a non-electrode UV lamp, a laser and a LED (Light-Emitting Diode). The ozone concentration above the recording substrate can be made to be not more than 5 ppm by combining with an ozone cutting filter or a strong exhaust duct or prolonging the irradiation distance. However, such the methods are inferior in the energy efficiency. In the viewpoint of efficiency, a light source which generates substantially no ozone such as the UV fluorescent lamp, the LED and the laser is preferably employed. A method can be also applied in which a high powder lamp is placed at a distant position from the surface to be irradiated and the light emitted from the light source is conducted to the surface to be irradiated by a light fiber or a mirror.

The ozone concentration on an irradiated surface of the substrate in the invention is defined as a concentration measured by Measurement of ozone concentration (Potassium iodide method) defined in JIS B 7957-1992. The concrete measuring method is described below.

Collection of Sample Gas

An objective ink-jet recording apparatus is operated, i.e. printing is conducted, for one hour in a closed room having a volume of 50 $m^2$±20% at a temperature of 25±2° C. and a relative humidity of 50%. Subsequently, 5 liter of Sample gas is collected by installing a collecting hole at a position in 5 cm from the surface of the substrate irradiated by the light source. The ozone concentration is measured and calculated by utilizing the Sample gas obtained by above-described method and following method.

<Reagents>

(Absorption Solution)

The absorption solution is neutral phosphate buffer solution of potassium iodide, and is prepared by using reagent not containing reducing materials.

For preparation of absorption solution of 1 liter, 10 g of potassium iodide, 13.61 g of potassium dihydrogen phosphate and 35.82 g of disodium hydrogenphosphate 12-hydrate are dissolved into 0.8 liter of water, the pH to 7.0 ±0.2 is adjusted by using sodium hydroxide solution or phosphoric acid and the obtained solution is made to 1 litter by adding water.

(Standard Solution of Iodine)

0.05 mol/l iodine solution 10.0/F ml (where F is factor of 0.05 mol/l iodine solution) is taken, and the absorption solution is added to make it 100 ml. Further, the obtained solution is diluted with absorption solution to 10 times and it is the standard solution of iodine. 1 ml of this standard solution of iodine corresponds to 12 $\mu lO_3$ (20° C., 101.325 kPa).

<Apparatus>

(Absorption Tube)

As for absorption tube, midget in-pin-jar of whole glass is used.

(Gas Meter)

The gas meter is one being able to measure the flow rate of 1 l/min of wet type, and is 1 l/revolution.

(Suction Pump)

The suction pump is able to obtain a flow rate of not less than 1 l/min when connected to the apparatus, and the one having no leakage of air is used.

(Photometer)

The spectrophotometer or photoelectric photometer capable of measuring at the wavelength of 352 nm is used.

<Sampling>

For the sampling, the apparatus specified above are used by connecting them. 10 ml of Absorption solution is poured into the absorption tube using a transfer pipet, and the above-described Sample gas is sampled at a constant rate of 0.95 to 1.05 l/min. During this operation, the thermostatic water bath accommodating absorption tube is kept at 20±0.5° C.

<Operation>

The absorption solution in which the sample is, after leaving for 30 min, immediately poured from the sampling apparatus into a cell of 10 mm long in optical path.

For the said absorption solution, the absorbency in the vicinity of 352 nm shall be measured in accordance with JIS K 0115. As for the reference solution the original absorption solution is used. The temperature of the solution at the time of being left as it is maintained at 20±0.5° C. During such period of time, the inlet and outlet of sample air of the in-pin-jar is sealed with paraffin film or the like. The time from pouring the absorption solution in the cell to the measurement of absorbancy is within 5 min.

Volume of the ozone is obtained from the working curve. In the preparation of wording curve, 0 to 10 ml of standard solution of iodine is taken stepwise into 100 ml measuring flask. Absorption solution is added up to the marked line. Subsequently, Operation is conducted in accordance with above-mentioned, and the relation curve between the ozone quantity and the absorbency is prepared.

<Calculation>

(Conversion of Collected Quantity of Sample Gas)

The collected quantity of sample gas is converted to the volume at 20° C., and 101.325 kPa from the following formula:

$$V_s = V \times 293/(273+t) \times (P_a + P_m - P_v)/101.325$$

Wherein $V_s$ is sampled quantity of Sample gas (l), V is Sample gas quantity measured with gas meter (l), t is temperature at gas meter (° C.), $P_a$ is atmospheric pressure (kPa), $P_m$ is gauge pressure at gas meter (kPa), and $P_v$ is saturated vapor pressure at t ° C. (kPa)

(Calculation of Ozone Concentration)

The ozone concentration in Sample gas is calculated from the following formula:

$$C = v/V_s$$

Wherein C is the ozone concentration (volppm), v is ozone quantity obtained from working curve ($\mu$l), and $V_s$ is sampled quantity of Sample gas (l).

In the invention, the light source, which generates substantially no ozone, is preferably used. The light source generating substantially no ozone is a light source satisfying the following condition: the ozone concentration measured and calculated by Measurement of ozone concentration (Potassium iodide method) defined in JIS B 7957-1992 described above is not more than 5 ppm. The sample gas is collected after the light source is continuously operated for 1 hour in a room having a volume of 50 $m^3$±20% at a temperature of 25±2° C. and a relative humidity of 50%, and a collecting hole to collect the Sample gas is set so that the distance from the floor is 1.2 m.

In the invention, it is preferred to arrange the light source along the widths direction of printing to irradiate light to the printed image with a predetermined time lag after the landing of the ink to the substrate.

In the method according to the invention, the time lag from the landing of the ink to the light irradiation is preferably 0.0005 to 1 seconds. By controlling the time lag to be in the above range, the head contamination by a sublimated substance formed by the hardening of the ink, or the nozzle clogging by the scattered light, which is caused by too close distance from the light source to the nozzle, can be prohibited. Further, fluctuation of the shape of the dot depending on the substrate can be prohibited and the stable image quality can be obtained.

When the irradiation intensity has a gradient in the irradiation area, the time from the landing of the ink to the irradiation is measured according to the irradiation stating time defined at the time when the intensity is reached to 1/10 of the maximum intensity of the irradiation.

Substrate

There is no limitation on the substrate usable in the invention. Preferable substrate is a substrate so-called as non-ink absorbable material which does not have an ink-absorption layer such as a paper-like fibriform layer for absorbing the ink, a layer of resin capable of swelling by absorbing the ink provided on a film or a porous layer having pores therein formed by filler or resin particles. Concrete example of preferable one include paper coated with resin on the surface thereof, a plastic film, a plastic sheet, metal, ceramic and glass.

(Ink)

As the UV hardenable ink to be used in the invention, a known composition hardenable by UV light is usable. For example, a mixture of a radical polymerization initiator and a radical polymerizable compound and a mixture of cationic polymerization initiator and a cationic polymerizable compound are used. In concrete, inks described in JP O.P.I. Publication Nos. 3-243671, 2000-38531, 2-311569 and 3-216379, and WO99/29787 are usable. Among them, ink containing the cationic polymerization initiator and the cationic polymerizable compound is preferred.

The radical polymerizable compound is a compound having a radical polymerizable ethylenic unsaturated bond. Any compound having at least one radical polymerizable ethylenic unsaturated bond can be used which includes ones having a chemical situation of monomer, oligomer or polymer. The radical polymerizable compound may be used solely or in combination of two or more kinds thereof in an optional ratio for improving an objective property.

Examples of the compound having the ethylenic unsaturated bond include radical polymerizable compounds, for example, a unsaturated carboxylic acid such as acrylic acid, methacrylic acid, itaconic acid, crotonic acid, iso-crotonic acid and maleic acid, and their salts, ester, urethane, amide and anhydride; acrylonitryl, styrene, various kinds of unsaturated polyester, unsaturated polyether, unsaturated polyamide and unsaturated urethane. Concrete examples include acrylic acid derivatives such as 2-ethylhexyl acrylate, 2-hydroxyethyl acrylate, butoxyethyl acrylate, carbitol acrylate, cyclohexyl acrylate, tetrahydrofurfural acrylate, benzyl acrylate, bis(4-acryloxypolyethoxyphenyl)propane, neopentyl glycol diacrylate, 1,6-hexanediol diacrylate, ethylene glycol diacrylate, diethylene glycol diacrylate, tri ethylene glycol diacrylate, tetraethylene glycol diacrylate, polyethylene glycol diacrylate, polypropylene glycol diacrylate, pentaerythritol triacrylate, pentaerythritol tetracarylate, trimethylolpropane triacrylate, tetramethylolmethane tetracrylate, oligoester acrylate, N-metylol acrylamide, diacetone acrylamide and epoxy acrylate; a methacrylic acid derivative such as methyl methacrylate, n-butyl methacrylate, 2-ethylhexyl methacrylate, lauryl methacrylate, allyl methacrylate, glycidyl methacrylate, benzyl methacrylate, dimethylaminomethyl methacrylate, 1,6-hexanediol dimethacrylate, ethylene glycol dimethacrylate, triethylene glycol dimethacrylate, polyethylene glycol dimethacrylate, polypropylene glycol dimethacrylate, trimethylolethane trimethacrylate, trimethylolpropane trimethacrylate and 2,2-bis(4-methacrylopolyethoxyphenyl)propane; and allyl derivatives such as allyl glycidyl ether, diallyl phthalate and triallyl trimeritate, a radical polymerizable or crosslink formable monomer, oligomer and polymer known in the field of the industry or available on the market which are described in "Crosslinking agent Handbook" edited By S. Yamashita, Taisei-sha, 1981, "UV-EB Hardening Handbook" edited by K. Katou, Kobunshi Kankokai, 1985, "Application and Market of UV-EB Hardening Technology" p. 79, edited by Radotech Kenkyuukai, CMC, 1989, and E. Takiyama "Polyester Resin Handbook" Nikkan Kogyo Shinbun-sha, 1988. The adding amount of the radical polymerizable compound is preferable from 1 to 97% by weight, more preferably from 30 to 95%, by weight.

As the radical polymerization initiator, the followings are usable: triazine derivatives described in Japanese Patent Examined Publication, hereinafter referred to as JP Publication, Nos. 59-1281 and 61-621, JP O.P.I. Publication No. 60-60104, organic peroxide compounds described in JP Publication No. 59-1504 and JP O.P.I. Publication No. 61-243807, diazonium compounds described in JP Publication Nos. 43-23684, 44-6413 and 47-1604 and U.S. Pat. No. 3,567,453, organic azide compounds described in U.S. Pat. Nos. 2,848,328, 2,852,379, and 2,940,853, orthoquinonediazide described in JP Publication Nos. 36-22062, 37-13109, 38-18015 and 45-9610, onium compounds described in JP Publication No. 55-93162, JP O.P.I. Publication No. 59-14023 and "Macromolecules" vol. 10, p. 1307, 1977, azo compound described in JP O.P.I. No. 59-142205, metal allene complexes described in JP O.P.I. Publication No. 1-54440, EP Nos. 109,851 and 126,712, and "Journal of Imaging Science" vol. 30, p. 174, 1986, (oxo)sulfonium organic boron complexes described in Japanese Patent Application Nos. 4-56831 and 4-89535, titanosen compounds described in JP O.P.I. No. 61-151197, transition metal complexes containing a transition metal such as ruthenium described in "Coordination Chemistry Review" vol. 84, p.p. 85–277, 1988, and JP O.P.I. Publication No. 2-182701, 2,4,5-triarylimidazole dimer and carbon tetrabromide described in JP O.P.I. No. 3-209477, and organic halogen compounds described in JP O.P.I. Publication No. 59-107344. Such the polymerization initiator is preferably contained in an amount of from 0.01 to 10 parts by weight in 100 parts of the radical polymerizable compound having the ethylenic unsaturated bond.

Various kinds of known cationic polymerizable monomer can be used as the cationic polymerizable compound. Examples of the cationic polymerizable compound include epoxy compounds, vinyl ether compounds and oxetane compounds exemplified in JP O.P.I. Publication Nos. 6-9714, 2001-31892, 2001-40068, 2001-55507, 2001-310938, 2001-310937 and 2001-220526.

The preferable aromatic epoxide is a di- or poly(glycidyl ether) produced by the reaction of a polyvalent phenol or its alkylene oxide adduct and epichlorohydrin, for example, a di- or poly(glycidyl ether) of bisphenol A or its alkylene oxide adduct, a di- or poly-glycidyl ether of hydrogenated bisphenol A or its alkylene oxide adduct and a novolak type epoxy resin. As the alkylene oxide, ethylene oxide and propylene oxide are applicable.

As the aliphatic cyclic epoxide, a compound containing cyclohexane oxide or cyclopentene oxide is preferable which can be obtained by epoxizing a compound having at least one cycloalkane ring such as cyclohexene or cyclopentene by a suitable oxidant such as hydrogen peroxide and a per acid.

A di- or poly(glycidyl ether) of an aliphatic polyvalent alcohol or its alkylene oxide adduct can be cited as the preferable aliphatic epoxide compound. Typical examples of that include a diglycidyl ether of alkylene glycol such as diglycidyl ether of ethylene glycol, diglycidyl ether of propylene glycol, diglycidyl ether of 1,6-hexanediol; a polyglycidyl ether of a polyvalent alcohol such as a di- or tri-glycidyl ether of glycerol or its alkylene oxide adduct; and a diglycidyl ether of a poly(alkylene glycol) such as diglycidyl ether of poly(ethylene glycol) or its alkylene oxide adduct and diglycidyl ether of polyethylene glycol or its alkylene oxide adduct. In the above, for example, ethylene oxide and propylene oxide are applicable as the alkylene oxide.

In these epoxides, the aromatic epoxide and the aliphatic cyclic epoxide are preferable and the aliphatic cyclic epoxide is particularly preferred. In the invention, the epoxide compounds may be used solely or in optional combination of two or more kinds.

As the vinyl ether compound, the followings are usable: di- or tri-vinyl ether compounds such as ethylene glycol divinyl ether, diethylene glycol divinyl ether, triethylene glycol divinyl ether, propylene glycol divinyl ether, dipropylene glycol divinyl ether, butanediol divinyl ether, hexanediol divinyl ether, cyclohexanedimethanol divinyl ether and trimethylolpropane trivinyl ether; and monovinyl ether compounds such as ethyl vinyl ether, n-butyl vinyl ether, isobutyl vinyl ether, octadecyl vinyl ether, cyclohexyl vinyl ether, hydroxybutyl vinyl ether, 2-ethylhexyl vinyl ether, cyclohexanedimethanol monovinyl ether, n-propyl vinyl ether, isopropyl vinyl ether, isopropenyl ether-o-propylene carbonate, dodecyl vinyl ether and octadecyl vinyl ether.

Among these vinyl ether compounds, the di- or tri-vinyl ether compound is preferable considering the hardening ability, the contacting ability and the surface hardness. In the invention, the epoxide compounds may be used solely or in optional combination of two or more kinds.

The oxetane compound usable in the invention is a compound having an oxetane ring. All known oxetane compounds can be used. For example, such as those described in JP O.P.I. Publication Nos. 2001-220526 and 2001-310937 can be cited.

The oxetane compound to be used in the invention is preferably a compound having 1 to 4 oxetane rings. By using the compounds having 1 to 4 oxetane rings, handling property of the composition can be improved since the viscosity of the composition is optimized, and the hardened composition having a sufficient adhesiveness can be obtained since the glass transition point of the composition is optimized.

As the compounds having one oxetane ring, which can be preferably used in the present invention, a compound represented by the following Formula 1 is exemplified.

Formula 1

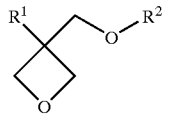

In Formula 1, $R^1$ is a hydrogen atom, an alkyl group having from 1 to 6 carbon atoms such as a methyl group, an ethyl group, a propyl group and a butyl group, a fluoroalkyl group having from 1 to 6 carbon atoms, an allyl group, an aryl group, a furyl group or a thienyl group. $R^2$ is an alkyl group having from 1 to 6 carbon atoms such as a methyl group, an ethyl group, a propyl group and a butyl group; an alkenyl group having from 2 to 6 carbon atoms such as a 1-propenyl group, a 2-propenyl group, a 2-methyl-1-propenyl group, a 2-methyl-2 propenyl group, a 1-butenyl group, a 2-butenyl group and a 3-butenyl group, a group having an aromatic group such as a phenyl group, a benzyl group, a fluorobenzyl group, a methoxybenzyl group and a phenoxyethyl group; an alkeylcarbonyl group having from 2 to 6 carbon atoms such as an ethylcarbonyl group, a propylcarbonyl group and a butylcarbonyl group; an alkoxycarbonyl group having from 2 to 6 carbon atoms such as an ethoxycarbonyl group, a propoxycarbonyl group and butoxycarbonyl group; or an N-alkylcarbamoyl group such as an ethylcarbamoyl group, a propylcarbamoyl group, a butylcarbamoyl group and a pentylcarbamoyl group. The use of the compound having one oxetane ring is particularly preferred in the invention since the obtained composition is excellent in the adhesiveness and working suitability since the viscosity is low.

An example of the oxetane compounds having two oxetane rings, which can be preferably used in the present invention, is a compound represented by the following Formula 2.

Formula 2

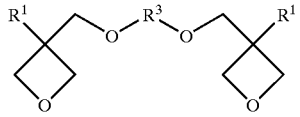

In Formula 2, $R^1$ is the same as that in Formula 1. $R^3$ is a linear or branched alkylene group such as an ethylene group, a propylene group and a butylene group, a linear or branched poly(alkyleneoxy) group such as a poly(ethylenoxy) group and a poly(propyleneoxy) group, a linear or branched unsaturated carbon hydride group such as a propenylene group, a methylpropenylene group and butenylene group, an alkylene group having a carbonyl group or a carbonyl group, a carbonyl group having a carboxyl group or an alkylene group having a carbamoyl group.

Moreover, $R^3$ may be also a polyvalent group selected from the groups represented by Formula 3, 4 or 5.

Formula 3

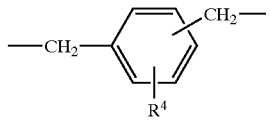

In Formula 3, $R^4$ is a hydrogen atom, an alkyl group having from 1 to 4 carbon atoms such as a methyl group, an ethyl group, a propyl group and a butyl group, an alkoxyl group having from 1 to 4 carbon atoms such as a methoxyl group, an ethoxyl group, a propoxyl group and a butoxyl group; a halogen atom such as a chlorine atom and bromine atom, a nitro group, a cyano group, a mercapto group, a lower alkylcarboxyl group, a carboxyl group or a carbamoyl group.

Formula 4

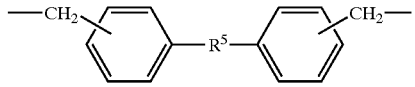

In Formula 4, $R^5$ is an oxygen atom, a sulfur atom, a methylene group, an NH group, an SO group, an $SO_2$ group, a $C(CF_3)_2$ or a $C(CH_3)_2$ group.

Formula 5

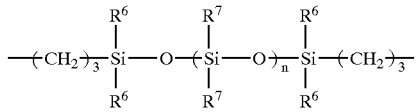

In Formula 5, $R^6$ is an alkyl group having from 1 to 4 carbon atoms such as a methyl group, an ethyl group, a propyl group, and a butyl group, or an aryl group; n is an integer of from 0 to 2,000. $R^7$ is an alkyl group having from 1 to 4 carbon atoms such as a methyl group, an ethyl group, a propyl group, and a butyl group, or an aryl group. $R^7$ may be a group selected from the groups represented by the following Formula 6.

Formula 6

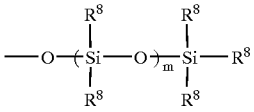

In Formula 6, $R^8$ is an alkyl group having from 1 to 4 carbon atoms such as a methyl group, an ethyl group, a propyl group, and a butyl group, or an aryl group; m is an integer of from 0 to 100.

The following compounds are the examples of the compound having two oxetane groups, which can be preferably used in the present invention.

Exemplified Compound 1

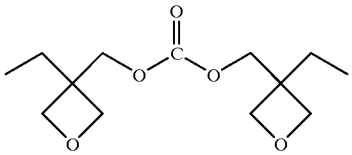

Exemplified compound 2

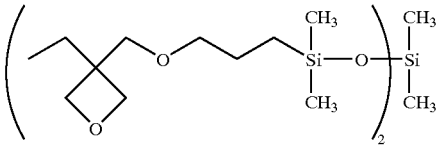

Exemplified Compound 1 is a compound of Formula 2 in which $R^1$ is a methyl group and $R^3$ is a carboxyl group. Exemplified Compound 2 is a compound of Formula 2 in which $R^1$ is a methyl group, $R^3$ is a group represented by the foregoing Formula 5, $R^6$ and $R^7$ are each a methyl group and n is 1.

A compound represented by the following Formula 7 is a preferable example of the compound having two oxetane rings other than the above-mentioned. In Formula 7, $R^1$ is the same as $R^1$ in Formula 1.

Formula 7

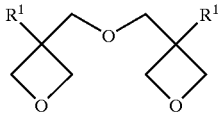

A compound represented by the following Formula 8 is an example of the compound having three to four oxetane rings, which can be preferably used in the present invention.

Formula 8

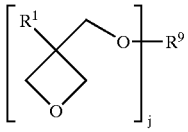

In Formula 8, $R^1$ is the same as $R^1$ in Formula 1. Groups represented by $R^9$ include a branched alkylene group having from 1 to 12 carbon atoms such as the groups represented by the following A to C, a branched polyalkyleneoxy group represented by the following D and a branched polysiloxy group represented by the following E. j is an integer of 3 or 4.

A

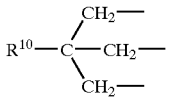

B

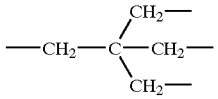

C

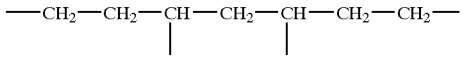

D

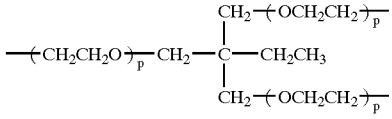

E

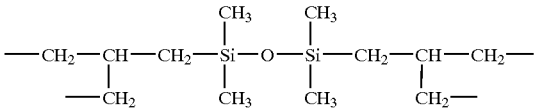

In the above A, $R^{10}$ is a lower alkyl group such as a methyl group, an ethyl group and a propyl group. In the above D, p is an integer of from 1 to 10.

Exemplified Compound 3 is an example of the compound having 3 or 4 oxetane rings, which can be preferably used in the present invention.

Exemplified Compound 3

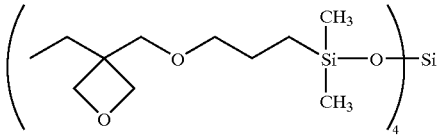

The compound represented by the following Formula 9 is an example of the preferable compound having from 1 to 4 carbon atoms.

Formula 9

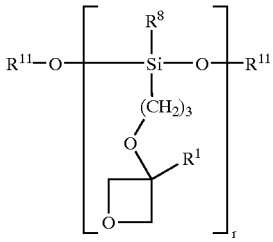

In Formula 9, $R^8$ is the same as $R^8$ in Formula 6. $R^{11}$ is an alkyl group having from 1 to 4 carbon atoms such as a methyl group, an ethyl group, a propyl group and a butyl group, or a trialkylsilyl group; and r is an integer of from 1 to 4.

Concrete examples of other preferable oxetane compounds usable in the invention include the following compounds.

Exemplified Compound 4

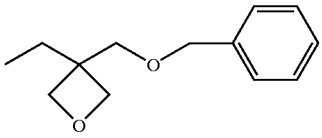

Exemplified Compound 5

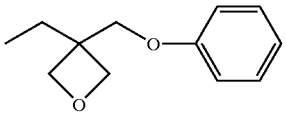

Exemplified Compound 6

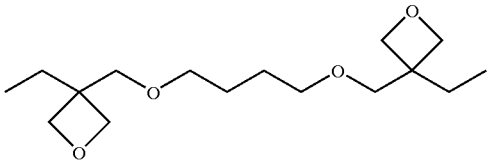

The above-mentioned compounds each containing the oxetane ring may be produced according to a known method without any limitation, for example, the method described in D. B. Pattison, J. Am. Chem. Soc., 3455, 79, 1957 is applicable by which the oxetane ring is synthesized from a diol. Other than the above, an oxetane compound having a molecular weight approximately from 1,000 to 5,000 and from 1 to 4 oxetane rings are also preferably applied. Concrete examples of such the compound include the following compounds.

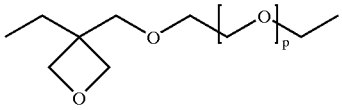

p: 20–200

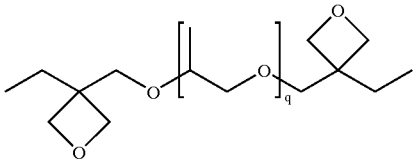

q: 15–100

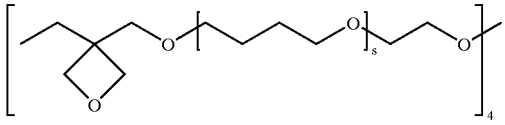

s: 20–200

A usable oxetane compound such as OXT 121 and OXT 221, produced by Toa Gousei Co., Ltd., is available on the market.

The content of the above-mentioned cationic polymerizable compound in the cationic polymerizable composition is 1 to 97%, preferably from 30 to 95%, by weight.

An aromatic onium salt can be used as the cationic polymerization initiator. Examples of the aromatic onium salt include a salt of an element of Va Group of the periodic table, for example a sulfonium salt such as triphenylphenasilsulfonium hexafluorophosphate; a salt of an element of VIa Group of the periodic table, for example, a sulfonium salt such as triphenylsulfonium tetrafluoroborate, triphenylsulfonium hexafluorophosphate, tris(4-tiomethoxyphenyl) sulfonium hexafluorophosphate and triphenylsulfonium hexafluoroantimonate; and a salt of an element of VIIa Group of the periodic table, for example, an iodonium salt such as diphenyliodonium chloride.

The use of the aromatic onium salt as the cationic polymerization initiator for the polymerization of the epoxy compound is described in detail in U.S. Pat. Nos. 4,058,401, 4,069,055, 4,101,513 and 4,161,478.

As the preferable cationic polymerization initiator, the sulfonium salts of the element of VIa Group of the periodic table. Among them, a triarylsulfonium hexafluoroantimonate is preferable from the viewpoint of the hardening ability by UV light and the storage stability of the UV hardenable composition. Moreover, the known photopolymerization initiators described in "Photopolymer Handbook" p.p. 39–56, edited by Photopolymer Konwakai, Kogyotyosakai, 1989, and the compounds described in JP O.P.I. Nos. 64-13142 and 2-4804 are optionally usable.

An additive such as a reaction diluting agent, filler, a flowing aid, a thixotropy agent, a wetting agent, a defoaming agent and a plasticizer may be added to the ink to be used in the invention. Moreover, a stabilizing agent such as a light fastness improving agent, a UV absorbent, an antioxidant, a polymerization preventing agent and a ant-corrosion agent; a Si compound and wax may be added to the ink.

Known water-soluble dyes, oil-soluble dyes and pigments can be used as the colorant to be used in the invention. The pigment is preferred in the invention.

Examples of the water-soluble dye include C.I. Direct Black-2, -4, -9, -11, -17, -19, -22, -32, -80, -151, -154, -168, -171 and -194; C.I. Direct Blue-1, -2, -6, -8, -22, -34, -70,-71, -76, -78, -86, -112, -142, -165, -199, -200, -201, -202, -203-207, -218, -236 and -278; C.I. Direct Red-1, -2, -4, -8, -9, -11, -13, -15, -20, -28, -31, -33, -37, -39, -51, -59, -62, -63, -73, -75, -80, -81, -83, -87, -90, -94, -95, -99, -101, -110 and -189; C.I. Direct Yellow-1, -2, -4, -8, -11, -12, -26, -27, -28, -33, -34, -41, -44, -48, -58, -86, -87, -88, -135, -142 and -144; C.I. Food Black-1 and -2; C.I. Acid Black-1, -2, -7, -16, -24, -26, -28, -31, -48, -52, -63, -107, -112, -118, -119, -121, -156, -172, -194 and -208; C.I. Acid Blue-1, -7, -9, -15, -22, -23, -27, -29, -40, -43, -55, -59, -62, -78, -80, -81, -83, -90, -102, -104, -111, -185, -294 and -254; C.I. Acid Red-1, -4, -8, 13, -14, -15, -18, -21, -26, -35, -37, -110, -144, -180, -249 and -257; and C.I. Acid Yellow-1, -3, -4, -7, -11, -12, -13, -14, -18, -19, -23, -25, -34, -38, -41, -42, -44, -53, -55, -61, -71, -76, -78, -79 and -122.

Examples of the oil-soluble dye include an azo dye, a metal complex dye, a naphthol dye, an anthraquinone dye, an indigo dye, a carbonium dye, a quinoimine dye, a cyanine dye, a quinoline dye, a nitro dye, a nitroso dye, a benzoquinone dye, a naphthoquinone dye, a naphthalimide dye, a perynone dye and a phthalocyanine dye. However, the oil-soluble dye is not limited to the above-mentioned.

Examples of the water-insoluble dye and the pigment include an organic pigment, an inorganic pigment, a water-insoluble dye, a dispersion dye and an oil-soluble dye without any limitation. As the black pigment, furnace black, lamp black, acetylene black and channel black are usable. Examples of usable carbon black include Raven 7000, Raven 5750, Raven 5250, Raven 5000 Ultra II, Raven 3500, Raven 2000, Raven 1500, Raven 1250, Raven 1200, Raven 1190 Ultra II, Raven 1170, Raven 1170, Raven 1255, Raven 1080 and Raven 1060, produced by Columbia Carbon Co., Ltd.; Regal 400R, Regal 1330R, Regal 1660R, Mogul L, Black Pearls L, Monarch 700, Monarch 800, Monarch 880, Monarch 900, Monarch 1000, Monarch 1100, Monarch 1300 and Monarch 1400, produced by Cabot Co., Ltd.; Color Black FW1, Color Black FW2, Color Black FE2V, Color Black 18, Color Black FW200, Color Black S150, Color Black S160, Color Black S170, Printex 35, Printex U, Printex 140U, Printex 140V, Special Black 6, Special Black 5, Special Black 4A and Special Black 4, produced by Deggusa Co., Ltd; and No. 25, No. 33, No. 40, No. 47, No. 52, No. 900, No. 2300, MCF-88, MA600, MA7, MA8 and MA100, produced by Mitsubishi Kagaku Co., Ltd. A magnetic fine powder such as magnetite and ferrite, and titanium black can be used as the black pigment.

Examples of the cyan pigment include C.I. Pigment Blue-1, Pigment Blue-2, Pigment Blue-3, Pigment Blue-15, Pigment Blue-15:1, Pigment Blue-15:3, Pigment Blue-15:34, Pigment Blue-16, Pigment Blue-22 and Pigment Blue-60.

Examples of the magenta pigment include C.I. Pigment Red-5, C.I. Pigment Red-7, C.I. Pigment Red-12, C.I. Pigment Red-48, C.I. Pigment Red-48:1, C.I. Pigment Red-57, C.I. Pigment Red-112, C.I. Pigment Red-122, C.I. Pigment Red-123, C.I. Pigment Red-146, C.I. Pigment Red-168, C.I. Pigment Red-184 and C.I. Pigment Red-202.

Examples of the yellow pigment include C.I. Pigment Yellow-1, C.I. Pigment Yellow-2, C.I. Pigment Yellow-3, C.I. Pigment Yellow-12, C.I. Pigment Yellow-13, C.I. Pigment Yellow-14, C.I. Pigment Yellow-16, 17, C.I. Pigment Yellow-73, C.I. Pigment Yellow-74, C.I. Pigment Yellow-75, C.I. Pigment Yellow-83, C.I. Pigment Yellow-93, C.I. Pigment Yellow-95, C.I. Pigment Yellow-97, C.I. Pigment Yellow-98, C.I. Pigment Yellow-144, C.I. Pigment Yellow-128, C.I. Pigment Yellow-129, C.I. Pigment Yellow-151 and C.I. Pigment Yellow-154.

A special color pigment such as red, green, blue, brown and white, a metal glossy pigment such as gold and silver, a colorless vehicle pigment and a plastic pigment can be used additionally to the foregoing black and the three primary colors, cyan, magenta and yellow. The pigments may be ones subjected to a surface treatment. As the surface treatment, a treatment by an alcohol, an acid, an alkaline or a coupling agent such as a silane coupling agent, a graft polymerization treatment, and a plasma treatment are applicable. The colorant to be used in the invention is preferably one containing a small amount of impurity. The purified colorant is preferably used since the usual product available on the market contains a large amount of the impurity. The content of the colorant in the ink composition containing the solid colorant is from 0.5 to 30%, preferably from 2 to 15%, by weight.

The pigment in the state of dispersion is preferably used in the invention. Various means such as a ball mill, a sand mill, an attrition mill, a roll mill, an agitator, a Henschel mixer, a colloid mill, an ultrasonic homogenizer, a pearl mill, a wet jet mill and a paint shaker can be used for dispersing the pigment. It is also preferable to remove coarse particles from the pigment dispersion by a centrifugal machine or a filter. The average particle diameter of the pigment dispersion to be used in the aqueous pigment ink is preferably from 10 to 200 nm, more preferably from 50 to 100 nm.

A surfactant may be contained according to necessity in the aqueous pigment ink to be used in the invention. Examples of the surfactant preferably used in the aqueous pigment ink according to the invention include an anionic surfactant such as a dialkylsulfosuccinate, an alkylnaphthalenesulfonate and a fatty acid salt; a nonionic surfactant such as a polyoxyethylene alkyl ether, a polyoxyethylene alkylaryl ether, an acetylene glycol and a polyoxyethylene-polyoxypropylene block copolymer; and a cationic surfactant such as an alkylamine salt and a quaternary ammonium salt. Among them, the anionic surfactant and the nonionic surfactant are preferred.

Other than the above-mentioned, a preservative, an anti-mould agent and a viscosity controlling agent may be additionally contained in the aqueous pigment ink to be used in the invention.

Examples of the dispersing agent for dispersing the pigment include a surfactant such as a higher fatty acid salt, an alkylsulfuric acid salt, an alkyl ester sulfuric acid salt, an alkylsulfonic acid salt, a sulfosuccinic acid salt, a naphthalenesulfonic acid salt, an alkylphosphoric acid salt, a polyoxyalkylene alkyl ether phosphoric acid salt, a polyoxyalkylene alkylphenyl ether, polyoxyethylene polyoxypropylene glycol, a glycerol ester, a solbitol ester, a polyoxyethylene fatty acid amide and an amine oxide; and a block copolymer, a random copolymer and their salts derived from two or more unit selected from the group consisted of styrene, a styrene derivative, a vinylnaphthalene derivative, acrylic acid, an acrylic acid derivative, maleic acid, a maleic acid derivative, itaconic acid, an itaconic acid derivative, fumaric acid and a fumaric acid derivative.

Various means such as a ball mill, a sand mill, an attrition mill, a roll mill, an agitator, a Henschel mixer, a colloid mill, an ultrasonic homogenizer, a pearl mill, a wet jet mill and a paint shaker can be used for dispersing the pigment. It is also preferable to remove coarse particles from the pigment dispersion by a centrifugal machine or a filter.

The pH value of the ink to be used in the invention is preferably from 4 to 10, more preferably from 5 to 9.

The surface tension of the ink to be used in the invention is preferably from 20 to 60 mN/m, more preferably from 25 to 50 mN/m, considering the wetting ability with the recording medium and the nozzle of the head. When the surface tension is lower than 20 mN/m, the ink tends to overflow from the nozzle, and when the surface tension is higher than 60 mN/m, the drying time is prolonged.

A surfactant may be contained according to necessity for controlling the surface tension. Examples of the surfactant preferably used in the aqueous pigment ink according to the invention include an anionic surfactant such as a dialkylsulfosuccinate, an alkylnaphthalenesulfonate and a fatty acid salt; a nonionic surfactant such as a polyoxyethylene alkyl ether, a polyoxyethylene alkylaryl ether, an acetylene glycol and a polyoxyethylene.polyoxypropylene block copolymer; and a cationic surfactant such as an alkylamine salt and a quaternary ammonium salt. Among them, the anionic surfactant and the nonionic surfactant are preferred.

EXAMPLES

The invention is concretely described below referring the examples. The invention is not limited to the examples.

Example 1

Ink-Jet Head/Ink-Jet Printer Engine

FIG. 1 shows a cross section of an ink-jet head of an example of an ink-jet printer using the UV hardenable ink to be used in the invention.

In the ink supplying system, the ink is supplied to a piezo type ink-jet head 19 from a source tank through a supplying pipe and a filter, they are not shown in the drawing, and a supplying pipe 5.

In the figure, 1 is a base plate, 2 is a piezo element, 3 is a plate forming a ink flowing channel, 3*a* is a ink flowing channel, 4 is a ink supplying tank, 4*a* is a ink room, 5 is the ink supplying pipe, 6 is a nozzle plate, 6*a* is a nozzle, 7 is a print circuit plate for driving, 8 is a lead wire, 9 is a driving electrode, 11 is a protective plate, 16 is a heater, 17 is a power source of the heater, 18 is a heat conducting member and 19 is the ink-jet head constituted by the above-mentioned.

The ink-jet head is thermally insulated and heated by the heater 16. A thermal sensor was arranged near the ink supplying tank and the nozzle of the ink-jet nozzle; and the temperature of the nozzle portion was controlled so as to be constantly at a designated temperature ±2° C. The pitch of the nozzles was 300 dpi and 512 nozzles were provided per nozzle head. The dpi is a number of the nozzle per 2.54 cm. The diameter of the nozzle and the ejecting temperature were each set at 20 μm and 80° C. The ejection was carried out by a driving voltage of 15 V. The recording density was 600 dpi.

Figure 2:
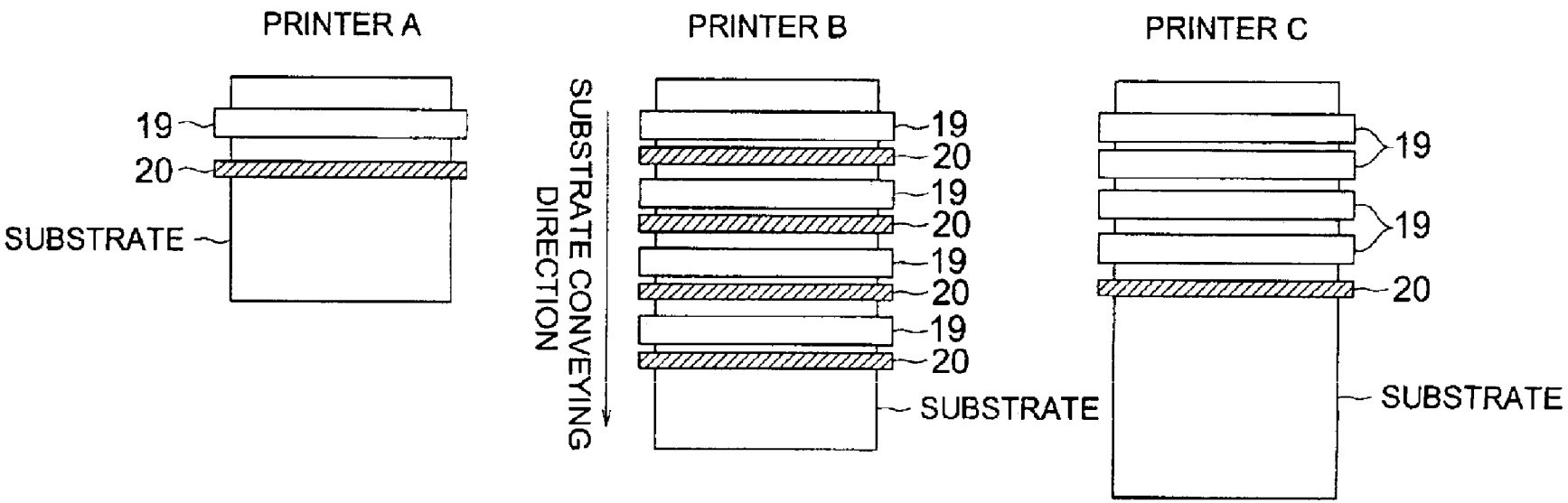
FIG. 2 shows schematic drawings of an ink-jet printer in which an ink-jet head and a light source irradiating UV light are arranged.

FIG. 2 shows a schematic drawing of the ink-jet printer which has the foregoing ink-jet head 19 and an UV light irradiating source 20. In Printer A, the irradiation light source 20 is arranged so that UV light is irradiated just after the printing by one ink-jet head 19. In Printer B, ink-jet heads 19 and light sources 20 are alternatively arranged so that multi-step printing and multi-step irradiation are performed. In Printer C, the ink-jet heads 19 and the light source 20 are arranged so that the irradiation by UV light is finally performed after multi-step printing.

Preparation of Ink for Ink-Jet Printing

Ink Set A

Ink set A was prepared by combination of inks of yellow (Y), magenta (M), cyan (C) and black (B), each having the composition shown in Table 1. In the table, the composition is represented by parts by weight.

TABLE 1

| Material Colorant | | Ink set A K CI pigment Black 7 | C CI pigment Blue 15:3 | M CI pigment Red 57:1 | Y CI pigment Yellow 13 | Remarks |
|---|---|---|---|---|---|---|
| Amount of colorant | | 5.0 | 2.5 | 3.0 | 2.5 | |
| Cationic polymerizable compound | OXT-221 Toa Gosei Co., Ltd.) | 51.0 | 58.5 | 58.0 | 58.5 | Oxetan compound |
| Cationic polymerizable compound | Celloxide 2021P (Daicel Kagaku Kogyo Co., Ltd.) | 20.0 | 20.0 | 20.0 | 20.0 | Epoxy compound |
| Cationic polymerizable compound | GT403 (Daicel Kagaku Kogyo Co., Ltd.) | 15.0 | 10.0 | 10.0 | 10.0 | Vinyl ether compound |
| Acid increasing agent | Acpres 11M (Nihon Chemics Co., Ltd.) | 3.0 | 3.0 | 3.0 | 3.0 | |
| Cationic polymerization initiator | MP1103 (Midori Kagaku Co., Ltd.) | 5.0 | 5.0 | 5.0 | 5.0 | |
| Initiator aid | Dirthylthioxantone | 1.0 | 1.0 | 1.0 | 1.0 | |

Ink Set B

Ink set B was prepared by combination of inks of yellow (Y), magenta (M), cyan (C) and black (B), each having the composition shown in Table 2.

TABLE 2

| Material Colorant | | Ink set B K CI pigment Black 7 | C CI pigment Blue 15:3 | M CI pigment Red 57:1 | Y CI pigment Yellow 12 | Remarks |
|---|---|---|---|---|---|---|
| Amount of colorant | | 3.0 | 3.0 | 3.0 | 2.0 | |
| Polymer dispersing agent | Solsperse (Zeneca Co., Ltd.) | 1.0 | 1.0 | 1.0 | 1.0 | |
| Radical polymerizable compound | Stearyl acrylate | 76.0 | 76.0 | 76.0 | 77.0 | Acryl compound |
| Radical polymerizable compound | Tetraethylene glycol diacrylate (Two-function) | 10.0 | 10.0 | 10.0 | 10.0 | Acryl compound |
| Radical polymerizable compound | Caproluctum-modified dipentaerythritol hexacrylate (six-function) | 5.0 | 5.0 | 5.0 | 5.0 | Acryl compound |
| Radical polymerization initiator | Irugacure 184 (Ciba Co., Ltd.) | 5.0 | 5.0 | 5.0 | 5.0 | |

Ink-Jet Recording Process

Ink sets A and B were set in Printer A shown in FIG. 2, and an ink-jet recorded image was formed on the recording medium by ink ejection. The light from the later-mentioned light source was condensed to each of the colors after the ink ejection and the lighting system was arranged so that UV irradiation was started 0.1 seconds after the landing of the ink.

The ink supplying system of the ink-jet recording apparatus was constituted by the ink tank, the ink tank arranged at just before the ink-jet head, the ink flowing channel and the ink-jet head; and the portion from the ink tank to the ink-jet head was thermally insulated and heated.

The temperature of the ink on the occasion of the ejection was 80° C. The viscosity of each of the inks was measured by a rotational viscometer Model EDL manufactured by Tokimec Co., Ltd. The viscosities of the inks were each within the range of from 2 to 50 mPa·s.

The ozone concentration on the irradiated surface of the substrate was measured by above-described measuring-and-calculating method.

Moreover, the scratch resistibility and the light fastness of the image were evaluated when the irradiation was carried out under the condition shown in Table 3.

Irradiating Light Source

Black light: Black light FL40SB LB-A, manufactured by Toshiba Lightech Co., Ltd. Principal wavelength: 365 nm High pressure mercury lamp: High pressure mercury lamp manufactured by Nihon Denchi Co., Ltd. Principal wavelength: 365 nm Scratch Resistibility The load in gram necessary to initially form a scratch was measured just after the image formation by HEIDON scratch testing machine with a needle radius of 1.0 mm and an applicable loading of 200 g.

Light Fastness

Solid colored patches were prepared as to each of the color of C, M, Y and B. The patches were stood out door for 3 months and the image remaining ratio in percent was measured as to each of the patches. The image remaining ratio was represented by the average of the ratio of the image density after to that before the standing of each of the colors.

Results of the evaluation are shown in Table 3.

TABLE 3

| Sample No. | Ink set | Light source: Kind | Light source: Irradiation distance (mm) | Light source: Irradiation energy (mj/cm$^2$) |
|---|---|---|---|---|
| 1 | A | Black light | 1 | 150 |
| 2 | B | High pressure mercury lamp | 100 | 80 |

| Sample No. | Ozone concentration (ppm) | Scratch resistibility (g) | Light fastness (%) | Remarks |
|---|---|---|---|---|
| 1 | 0 | 150 | 95 | Inventive |
| 2 | 10 | 80 | 80 | Comparative |

The ink-jet image forming method excellent in the hardening ability of the image surface and the durability of the image can be provided by the invention.

What is claimed is:

1. An ink-jet image forming method comprising:

jetting UV-hardenable ink onto a substrate; and irradiating UV light to the jetted UV-hardenable ink on the substrate with a UV light source to form an image, wherein an ozone concentration on an irradiated surface of the substrate during the irradiating step is not more than 5 ppm by volume.

2. The ink-jet image forming method of claim 1, wherein the UV light source generates substantially no ozone.

3. The ink-jet image forming method of claim 1, wherein the UV light source is selected from the group consisting of a UV fluorescent lamp, a laser and a light-emitting diode.

4. The ink-jet image forming method of claim 3, wherein the UV light source is the UV fluorescent lamp.

5. The ink-jet image forming method of claim 3, wherein the UV light source is the light-emitting diode.

6. The ink-jet image forming method of claim 1, wherein during the irradiating step, an ozone cutting filter is installed between the UV light source and the substrate.

7. The ink-jet image forming method of claim 1, wherein during the irradiating step, at least a part of air between the UV light source and the substrate is sucked.

8. The ink-jet image forming method of claim 1, wherein a viscosity of the UV-hardenable ink at the temperature when the UV-hardenable ink is jetted is 2 to 50 mP·s.

9. The ink-jet image forming method of claim 1, wherein the UV-hardenable ink contains a cationic polymerization initiator and a cationic polymerizable compound.

10. The ink-jet image forming method of claim 9, wherein the UV-hardenable ink contains the cationic polymerizable compound selected from the group consisting of epoxy compounds, vinyl ether compounds and oxetane compounds.

11. The ink-jet image forming method of claim 10, wherein the UV-hardenable ink contains the oxetane compound.

12. The ink-jet image forming method of claim 11, wherein the UV-hardenable ink contains the oxetane compound having 1 to 4 oxetane rings in the molecule.

13. The ink-jet image forming method of claim 9, wherein the cationic polymerization initiator is a sulfonium salt of an element of VIa Group of the periodic table.

14. The ink-jet image forming method of claim 13, wherein the sulfonium salt of the element is triarylsulfonium hexafuluoroantimonate.

15. The ink-jet image forming method of claim 1, wherein the irradiating step is started within 0.0005 to 1 second from the UV-hardenable ink is landed on the substrate.

16. An ink-jet image forming method comprising:

jetting UV-hardenable ink onto a substrate; and irradiating UV light by a light source to the jetted UV-hardenable ink on the substrate to form an image, wherein the UV light source generates substantially no ozone.

17. The ink-jet image forming method of claim 16, wherein the UV light source is selected from the group consisting of a UV fluorescent lamp, a laser and a light-emitting diode.

18. The ink-jet image forming method of claim 17, wherein the UV light source is the UV fluorescent lamp.

19. The ink-jet image forming method of claim 17, wherein the UV light source is the light-emitting diode.

* * * * *